United States Patent [19]

Campbell

[11] Patent Number: 5,044,278

[45] Date of Patent: Sep. 3, 1991

[54] ELECTRICALLY IGNITIBLE CARTRIDGE SYSTEM

[75] Inventor: W. D. Campbell, Los Angeles, Calif.

[73] Assignee: James E. Meagher, La Canada, Calif.

[21] Appl. No.: 376,236

[22] Filed: Jul. 3, 1989

[51] Int. Cl.[5] ..... F42B 5/08

[52] U.S. Cl. ..... 102/202.8; 102/202.9; 102/472; 42/84

[58] Field of Search ..... 102/472, 202.8, 202.9, 102/202.5; 42/84320111

[56] References Cited

U.S. PATENT DOCUMENTS

| | | | |
|---|---|---|---|
| 276,451 | 4/1883 | Monfort | 42/84 |
| 317,409 | 5/1885 | Monfort | 102/472 |
| 365,842 | 7/1887 | Monfort | 102/472 |
| 372,046 | 10/1887 | Stuart | 102/202.9 |
| 606,440 | 6/1898 | Bennett | 102/202.9 |
| 1,076,530 | 10/1913 | Terpins | 42/84 |
| 1,782,148 | 11/1930 | Ross | 42/84 |
| 2,226,988 | 12/1940 | Woodworth | 102/202.13 |
| 2,393,629 | 1/1946 | Grant, Jr. | 102/202.9 |
| 2,855,848 | 11/1958 | Books et al. | 102/472 |
| 2,980,019 | 4/1961 | Noddin | 102/202.8 |
| 2,981,186 | 4/1961 | Stresau | 102/202.9 |
| 2,986,090 | 5/1961 | Doerpinghaus | 102/202.8 |
| 3,132,586 | 5/1964 | Scharwachter | 102/202.5 |
| 3,196,041 | 7/1965 | McNulty et al. | 102/202.8 |
| 3,228,333 | 1/1966 | Phelps et al. | 102/472 |
| 3,298,306 | 1/1967 | Purdy | 102/202.9 |
| 3,344,744 | 10/1967 | Bankston, Jr. | 102/202.8 |
| 3,363,565 | 1/1968 | Walther | 102/472 |
| 3,427,972 | 2/1969 | Stadler et al. | 102/202.8 |
| 3,490,332 | 1/1970 | Damm | 102/472 |
| 3,577,923 | 5/1971 | Perkins | 102/472 |
| 3,728,967 | 4/1973 | Hinkle et al. | 102/202.8 |
| 3,754,506 | 8/1973 | Parker | 102/202.8 |
| 3,850,101 | 11/1974 | Sower | 102/202.8 |
| 4,130,060 | 12/1978 | Murray | 102/202.11 |
| 4,271,453 | 6/1981 | Yajima et al. | 361/264 |

FOREIGN PATENT DOCUMENTS

| | | | |
|---|---|---|---|
| 2053008 | 5/1972 | Fed. Rep. of Germany | 42/84 |
| 2245308 | 3/1974 | Fed. Rep. of Germany | 102/202.8 |
| 2551473 | 5/1977 | Fed. Rep. of Germany | 102/472 |
| 967649 | 11/1950 | France | 102/472 |
| 517732 | 2/1940 | United Kingdom | 102/472 |

*Primary Examiner*—Charles T. Jordan
*Assistant Examiner*—Stephen Johnson
*Attorney, Agent, or Firm*—Frederick E. Mueller

[57] ABSTRACT

A cartridge has a case of an electrically non-conductive material. A head of the case is typically formed with a coaxial through bore seating a terminal assembly comprising an annular electrode within which is an annular insulator holding a central electrode. A spark gap is defined between inner ends of the central electrode and annular electrode. The outer end of the central electrode terminates in a recess in the outer face of the head of the case in axially spaced relation to the outer end of the annular electrode. A hammer in operative association with the cartridge has spaced contact points in alignment with the annular electrode and central electrode, the contact points having the forementioned axial spacing. The entrance to the recess of the outer face of the head of the case is covered by an insulator which is displaceable by a boss on the opposed face of the hammer. Upon actuation of the hammer, the contact points penetrate the outer ends of the electrodes of the terminal assembly while the hammer boss is pierced by the central contact point and is displaced by the boss. In an alternative embodiment, the case may be made of a graphite composite and is externally coated with an insulator film.

29 Claims, 3 Drawing Sheets

ELECTRICALLY IGNITIBLE CARTRIDGE SYSTEM

FIELD OF THE INVENTION

The present invention relates to ammunition and, more particularly, to an electrically ignitible cartridge system.

BACKGROUND OF THE INVENTION

Typically, a cartridge, of whatever caliber, comprises a brass case or shell which has a charge of powder, a primer, and a bullet or projectile. After firing, essentially nothing remains of the original cartridge except the brass case, which is the most expensive element. The brass case is commonly thrown away, or sold for scrap, or recycled through a tedious and labor intensive reloading process.

U.S. Pat. No. 3,228,333 discloses an electrically actuated cartridge comprising a plastic cartridge case, which is significantly less expensive than the brass case of a conventional cartridge. However, the disclosed electrically actuated cartridge appears to be relatively fragile in construction and expensive to manufacture in that it relies upon a wire filament extending through the propellant charge or the inclusion of a finely divided electrically conductive material within the propellant and includes the bullet in the electrical circuit. Although the disclosed arrangement may be advantageous in dispensing with a primer assembly and in the provision of a plastic case, it may be impractical in terms of constituting an inexpensive, sturdy and reliable equivalent of a conventional brass case cartridge.

It is also known in the prior art to electrically ignite an explosive powder or the like by means of a spark gap structure rather than by means of a relatively fragile fine wire resistance element. Representative of such devices is the spark gap detonator of U.S. Pat. No. 3,754,506. However, these devices appear to be relatively complex in structure, frequently requiring an intricate assembly of sub-elements.

SUMMARY OF THE INVENTION

An object of the present invention is to provide an electrically ignitible cartridge system, including a nonmetallic cartridge case, of a safe, hardy and effective construction which is the substantial equivalent of a conventional brass-cased cartridge. To that end, the invention comprises a cartridge case fabricated from a nonconductive synthetic polymer such as Teflon, or a thermoplastic composite such as Ryton, or other such nonconductive materials which can be directly seated in the metallic breech of a firearm without the necessity for any breech-mounted insulative lining or coating. In another embodiment the cartridge case may be fabricated from a graphite composite or other conductive synthetic material and coated with an electrical insulating material such as a thin sheet of Delrin acetal resin. The overall external configuration of the cartridge case may be entirely conventional such as, for example, that of a rimmed or rimless design.

The wall of the cartridge case surrounds an internal chamber in which a charge of propellant is received above a head end of the case. The head of the cartridge case is preferably thick as compared to the radial thickness of the side wall of the case. The head of the case is formed with a shouldered coaxial counterbore therethrough to matingly receive a terminal assembly comprising an annular electrode of graphite, whose inner surface is also a counterbore to matingly seat a central coaxial insulator within which a central electrode is seated. The central electrode has a disc-like internal head whose periphery is in radially spaced relation to the surrounding annular electrode to define an annular spark gap. The inner end of the central electrode assembly defines the bottom of a shallow pocket, beneath the chamber receiving the propellant, in which pocket either part of the propellant may be housed or, alternatively, a primer mixture may be seated within the spark gap.

An external end of the central electrode is formed with a contact head received within an external pocket of the central insulator and in spaced relation to an overlying disc of an insulator material normally protecting the head of the central electrode from the ambient surroundings. A movable hammer is mounted in normally spaced apart co-axial alignment with the central portion of the head of the cartridge case. The hammer carries a plurality of electrically insulated conductors connected to an external source of electrical power. On the end face of the hammer in opposed relationship to the head of the cartridge case, these conductors terminate in hard, sharpened electrode contact points, one of which is aligned with the relatively soft external head of the central electrode of the case. A pair of the hard points, on diametrically opposite sides of the central contact point, are aligned with the relatively soft annular conductor of the case. That end of the case opposite to the head is press fitted with a bullet or projectile after the case has been loaded with a charge of propellant and, if desired, a primer mixture in the spark gap.

The central electrode point on the hammer is spaced axially in advance of the other two hard electrode points a distance corresponding to the depth that the external head of the center electrode of the case is spaced from the the external end of the annular electrode. A protruding boss on the opposed face of the hammer, containing the central contact point, is matingly receivable within the external pocket of the central insulator of the case in which the central electrode is mounted. Upon actuation or triggering of the hammer the boss punches the insulator disc into the pocket. The disc contains a central weakened point to facilitate piercing of the central contact point through the disc and into positive electrical contact with the central electrode essentially simultaneously with penetration of the surrounding pair of hardened points into the external end face of the annular electrode.

In an alternative embodiment of the invention, the external end of the central electrode takes the form of a pointed rod or shaft that extends into the external pocket formed in the central insulator. As before, the entrance to the external pocket is covered by an insulator disc formed with a weakened or readily frangible center. Instead of the boss on the hammer of the first embodiment, the opposing face of the hammer in the center is fitted with a cylindrical cup sized for mating reception within the external pocket of the central insulator. The leading edge of this cup is formed with a sharpened edge adapted to pierce and punch the insulator disc when the hammer is triggered to advance into contact with the base of the cartridge. In lieu of a central hardened contact point, the hammer is fitted with a spaced apart pair of prongs of a conductive material having reversely bent internal end portions normally biased into contact with one another. As the hammer advances towards the cartridge, the ends of the prongs are advanced into the external pocket of the central insulator and the protruding external point of the central terminal is received between and electrically connects to the reversely bent portions of the central contact. As before, the other two contact points of the hammer are driven into electrical engagement with opposite sides of the annular electrode.

In a third embodiment, the cartridge case is formed of an electrically conductive material, such as a graphite composite, that is completely encased in or coated with an electrically insulating material such as an acetal resin film. A coaxial central electrode is mounted in the base of the cartridge case within a central insulator whose external end is formed with a shallow pocket seating a headed external end of the central conductor. The inner end of the central conductor comprises a sharpened point within an internal pocket defined in the floor of the propellant chamber. The cartridge is actuated by essentially the same hammer as employed in the first embodiment in that the central contact point of the hammer comes into electrical contact with the headed external end of the central conductor while the other contact points penetrate the insulator coating at the head of the cartridge case and come into electrical contact with the electrically conductive material of the case.

In a fourth embodiment, comprising a case of an electrically insulating synthetic plastic, the annular conductor in the head of the case comprises tubular metallic shell, preferably of brass, containing a coaxial insulator which, in turn, coaxially mounts the central electrode. The central electrode terminates at its inner end in a point protruding above the inner end face of the central insulator and in spaced relation to radially inner ends of a pair of radially disposed arms preferably comprising integral parts of the inner end of the annular electrode. The external end of the central insulator is formed with a shallow pocket receiving a headed portion of the central electrode that is overlain by an insulator disc. The external end of the annular electrode is formed with a radial flange recessed within an annular cavity defined in the external end of the cartridge head. The device is actuated by essentially the same hammer construction as that of the first embodiment.

All of the various embodiments of the system and cartridge lend themselves to relatively inexpensive and efficient mass production particularly in that, in most of the embodiments, the annular electrode, central insulator and central electrode may be produced as sub-assemblies which are easily insertible into plastic cartridge cases which are appropriately configured for the particular sub-assembly.

DESCRIPTION OF THE PREFERRED EMBODIMENTS

Figure 1:
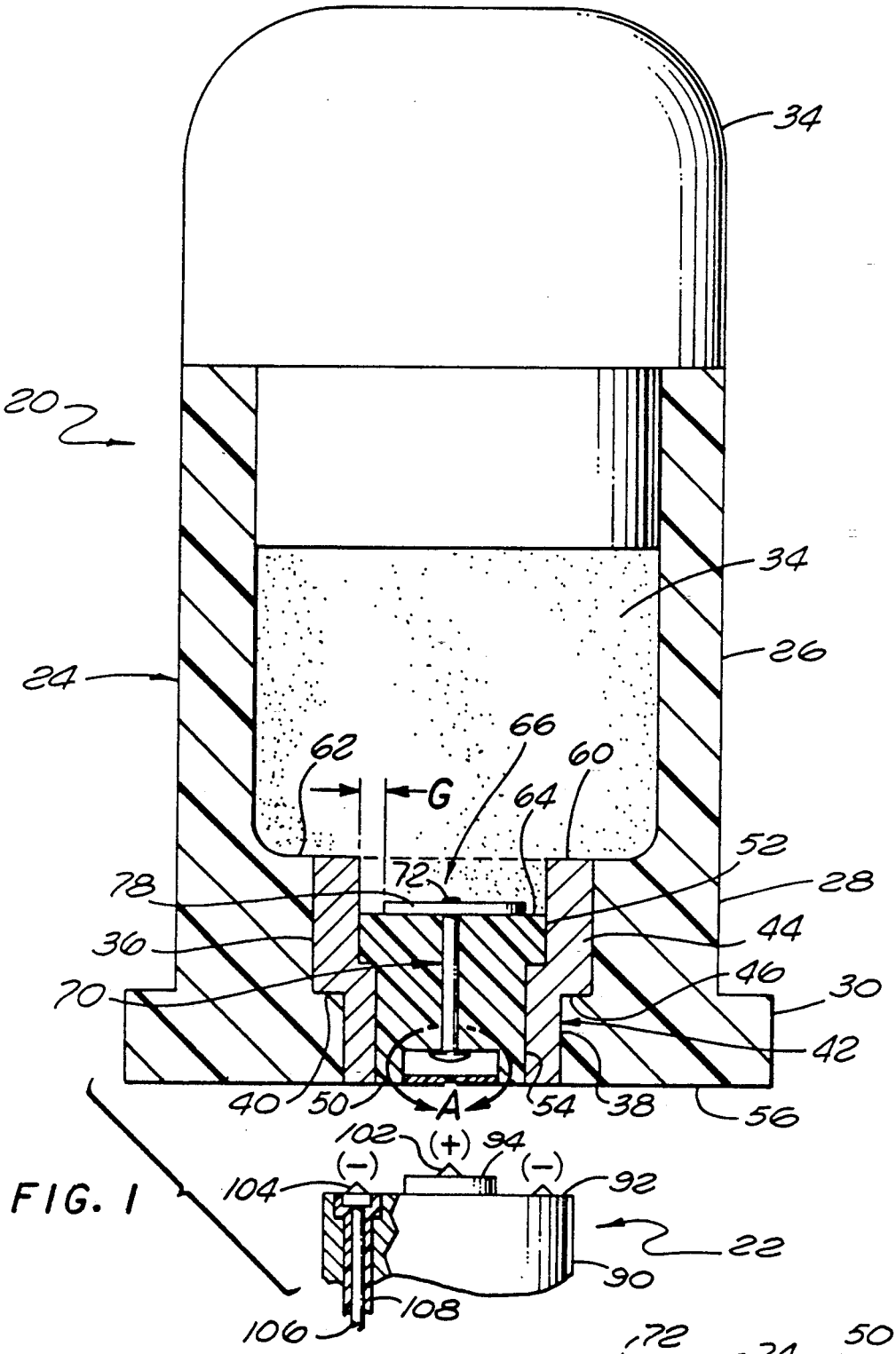
FIG. 1 is a side view of the cartridge system of this invention, portions of the cartridge assembly and of the hammer being shown in section in order to reveal inner details of construction.

Before explaining the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein is for the purposes of description and should not be regarded as limiting.

FIG. 1 schematically depicts a presently preferred embodiment of the electrically ignitable cartridge system of the invention, comprising a cartridge 20 and a hammer 22. The cartridge 20 may be externally configured for reception within the breech of the firearm of interest, in operative association with the hammer 22 of the firearm. While not shown, it will be understood that, as is well known in the art, the firearm is equipped with a means, such as the main spring of a rifle, to drive the hammer 22 against the external face of the head end of the cartridge.

More specifically, the cartridge 20 comprises a case 24 that is fabricated from an electrically nonconductive synthetic resin polymer, such as Teflon, and comprises a cylindrical wall section 26 formed integrally with a head end 28, which may have an extractor rim 30 in the case of a rimmed cartridge configuration. Cartridge wall 26 defines an internal chamber which is filled with a charge 32 of a selected propellant such as IMR 4320. A projectile or bullet 34 is press fitted or otherwise secured in the mouth of the case 24.

To fixedly seat a terminal assembly 42, the head 28 of the case 24 is formed with a co-axial through counterbore comprising a larger diameter section 36 and lesser diameter section 38, separated by a shoulder 40. A tubular or annular electrode 44 of assembly 42 is made of an electrically conductive material, such as graphite, formed with an external configuration matingly complementary to that of the counterbore and is seated on the shoulder 40. The inner surface of the annular electrode 44 is also of a counterbore configuration, including a shoulder 46.

A plug-like central insulator 50 of assembly 42, which may be made of a synthetic resin polymer like the material of the case 24, is seated within the annular electrode 44. More specifically, the insulator 50 comprises a larger diameter head section 52 whose underside is matingly seated on the shoulder 46 of annular conductor 44 and has a lesser diameter section 54. It will be noted that the outer ends of the annular conductor 54 and central insulator 50 are coplanar with a bottom face 56 of case 24. The shoulders 40 and 46 of the counterbore of the case 24 and annular conductor 44, respectively, face inwardly of the cartridge case to prevent expulsion of the components assembled within the counterbore in response to pressures generated during ignition or detonation of the propellant charge 32.

An inner end 60 of the annular electrode 44 is essentially flush with an inner face 62 of the cartridge case head section 28. The central insulator 50 is shorter than annular electrode 44 and has an inner end face 64 spaced beneath inner end 60 of the annular electrode 44. An inner pocket 66 is thus defined within the larger diameter section of annular electrode 44. The pocket 66 receives a portion of the propellant 32 or, alternatively, a primer mixture which may, for example, comprise tetracene, zirconium potassium percholorate, or boron calcium chromate.

Figure 1A:
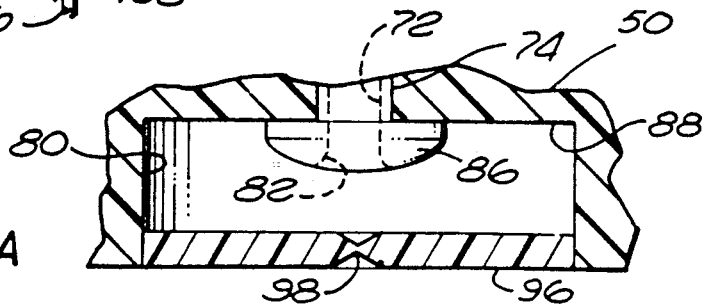
FIG. 1A is a view, on a larger scale, of the area A of FIG. 1.

The central insulator 50 coaxially mounts a central electrode of assembly 42 designated generally by the numeral 70. Preferably, for economy in fabrication, the central electrode may comprise a tubular rivet assembly, certain details of which can be best seen in FIG. 1A. More specifically, this assembly comprises a central shaft 72 axially slidably mounted within a surrounding sleeve 74 that is matingly received within a central bore 76 formed through insulator 50. These components are made of an electrically conductive metallic material. At its inner end, the sleeve 74 is press fitted with or integrally formed with a radially outwardly projecting disc 78. The outer end face of central insulator 50 is formed with a coaxial external pocket 80.

Before assembly of the central electrode 70, the lower or external end of the sleeve 74 and a bulbed or flared end 82 of the shaft 72 extend into the pocket 80 while an inner end portion (not shown) of the shaft 72 extends into internal pocket 66. As is well understood in the art of tubular pop or blind rivets, when the not-shown end of shaft 72 is pulled its flared outer end 82 swages and radially deforms the lower end of the sleeve 74 into a head 86 seated against an inner end 88 of the external pocket 80. The disc 78 of the inner end of the electrode 70 is thus fixed in place against the inner end face 64 of the central insulator 50. The not-shown protruding end of the shaft 72 breaks off approximately in the plane of the upper face of the disc 78. There is thus defined a spark gap G between the periphery of the disc 78 and the confronting area of the inner face of annular electrode 60. Usually the spark gap G will have a nominal value of from about 0.050 inches to about 0.030 inches but it will be understood that the actual value selected will be determined empirically and varies with the composition of the propellant or primer mixture contained within the spark gap.

The annular electrode 44, central insulator 50 and central electrode 70 may be fabricated as a sub-assembly which is then inserted into the cartridge case 24 through its open mouth prior to installation of the propellant and bullet. In that connection, an appropriate adhesive such as Furane 9320 may be used to join the parts 44, 50 and, also, to bond the sub-assembly into the counterbore through the head of the cartridge case. It will also be appreciated that the central electrode is to be made of a somewhat ductile material, such as brass, with care being taken to insure that there is satisfactory electrical conductivity between the head 86 and the periphery of the disc 78 of the electrode.

The hammer 22 may comprise a cylindrical steel body 90 operatively, e.g., coaxially, aligned with the cartridge 20. Preferably, the body 90 is at least as large in diameter as the external end of the terminal assembly. The hammer body 90 has a front face 92 opposing the external end of the terminal assembly that is integrally formed with a forwardly protruding cylindrical boss 94. The boss 94 is of a diameter to be matingly received within the outer pocket 80 of the central insulator 50. The entrance to the external pocket 80 is normally closed by a disc 96 of an insulating material such as a thin, e.g., 3 mil, disc of a synthetic resin polymer, such as Delrin or Teflon, which may be held in place by an appropriate adhesive compatible with the materials. The disc 96 serves to electrically insulate the head 86 of the central terminal 70 from the ambient surroundings and at its center, coaxial with the central terminal 70, is formed with a thin or weakened dot-like area 98 for a purpose to be described presently.

In order to generate an electrical potential in the spark gap G of the terminal assembly, the hammer body 90 is fitted with at least two, and preferably three, electrical terminal contact points of steel. In the illustrated case, a central contact point 102 protrudes from the forward face of the hammer boss 94 in coaxial alignment with the weakened point 98 of the disc 96 and the head 86 of the central terminal 70. The central contact point is flanked by a preferably diametrically oppositely positioned pair of contact points 104. As is indicated in FIG. 1 for the left hand contact 104. As is indicated in FIG. 1 for the left hand contact point 104, each of these contact points constitutes the terminal end of a conductor 106 extending longitudinally through the hammer body 90 that is insulated from the hammer body by means of an insulator sleeve 108. The conductors 106 for the contact points 102 and 104 are connected to an external electrical power source such as that, for example, disclosed in U.S. Pat. No. 4,355,263. The contact points 104 are aligned with diametrically opposite points on the external annular end face of the annular electrode 44.

Figure 2:
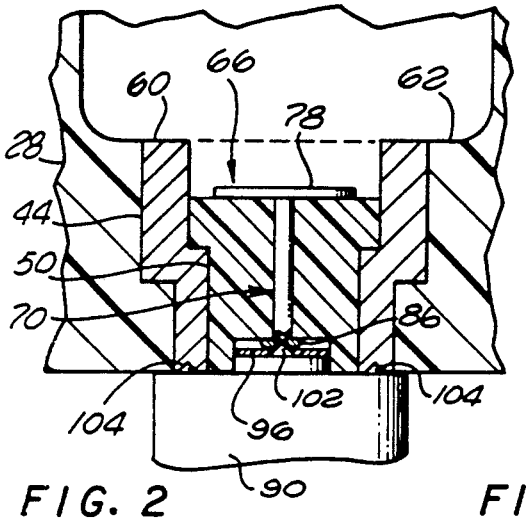
FIG. 2 is a sectional view showing the hammer and cartridge of FIG. 1 in electrical contact with one another.

The mode of operation of the invention is believed to be apparent from the foregoing description. Suffice it to say that when the hammer 22 is triggered the hammer body 90 is forcibly thrust against the exposed face of the terminal assembly 42. As a result, as indicated in FIG. 2, the insulator disc 96 is thrust into the external recess 80 by the hammer boss 94 while the central contact point 102 pierces the insulator disc at point 98 and penetrates into electrical contact with the relatively soft external head 86 of the central electrode 70. Simultaneously, the other pair of contact points 104 penetrate into and make electrical contact with the diametrically opposite points of the external end of the relatively soft annular electrode 44. An electrical potential is thus generated in the spark gap G to ignite the propellant 32 (or, alternatively, a primer mixture) within the spark gap and within the main chamber to expel the bullet 34.

FIGS. 3–11 illustrate alternative modifications of the invention wherein the same references numbers will be used to designate corresponding parts except for the addition of a distinguishing prefix, e.g., "1-".

Figure 3:
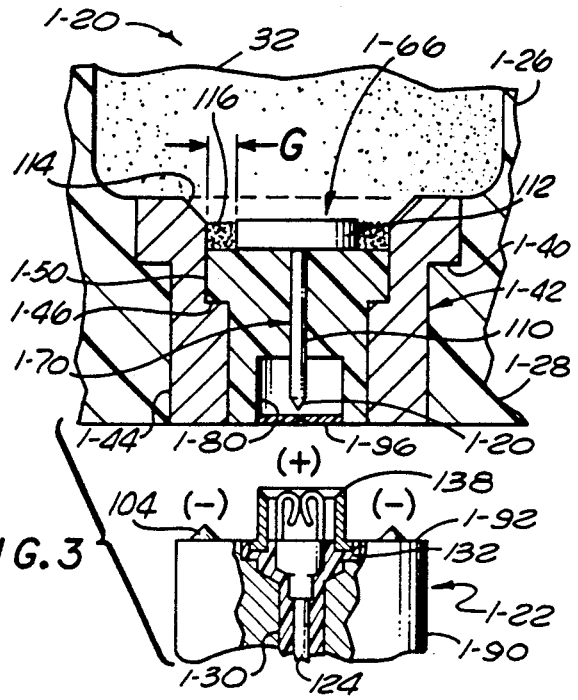
FIG. 3 is a partial sectional view of another embodiment of the invention.
Figure 4:
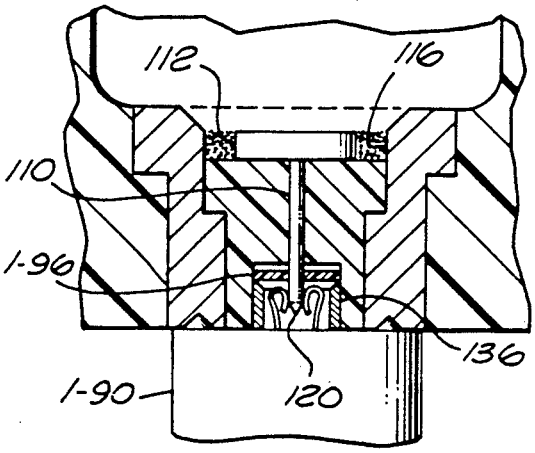
FIG. 4 is a view like FIG. 3 but showing the hammer in contact with the cartridge head.

Referring to FIGS. 3 and 4, the cartridge system comprises a cartridge 1-20 and a hammer 1-22. As before, the head 1-28 of cartridge case 1-26 is formed with a through counterbore defining a shoulder 1-46 for seating a terminal assembly 1-42. Assembly 42 comprises an annular electrode 1-44 whose inner surface includes annular shoulder 1-46 to seat a central insulator 1-50. A central electrode 1-70 is coaxially mounted in the central insulator 1-50.

In this case, the central electrode 1-70 takes the form of a metallic rod 110 coaxially affixed in the central insulator 1-50 and having an inner end integrally joined to a disc-like head 112. As before, the central insulator 1-50 is shorter than the other components of the terminal assembly such that an internal pocket 1-66 is defined within the upper end portion of the annular electrode 1-44. The inner surface of the inner end of the electrode 1-44 may be formed with an annular chamfer 114 such that spark gap G is defined between the peripheral surface of the head 112 of the central electrode and the surrounding confronting surface portion of the annular electrode 1-44. Preferably, a primer mixture 116 is loaded within the spark gap G immediately beneath the charge of propellant 32. In some cases, a cellulose nitrate membrane may be interposed between primer 116 and propellant 32.

The external end of the central insulator 1-50 is formed with an external pocket 1-80 into which a pointed end 120 of the central electrode shaft 110 extends. The entrance to the external pocket 1-80 is normally closed by an insulator disc 1-96 having weakened central area 1-98 in alignment with the point 120 of the central electrode.

As in the case of the first embodiment, the terminal assembly 1-42 may be fabricated as a sub-assembly which is fixed in place through the open end of the case 1-26 prior to loading the cartridge with a primer mixture 116 and propellant 32.

The hammer comprises a body 1-90 whose forward face 1-92 is fitted with a space pair of the previously described contact points 104 in alignment with diametrically opposite points of the external end of the annular electrode 1-44. However, in lieu of the central contact point 102 of the first embodiment, the hammer body 1-90 is coaxially fitted with a central conductor 124 whose forward end protrudes beyond the opposing face 1-92 of the hammer body. The operative protruding end of the conductor 124 comprises a symetrical pair of integrally formed opposed arms or fingers 126 the terminal end portions of which comprise reversely bent essentially U-shaped prongs 128. As is best seen in FIG. 3, the prongs 128 are symetrically disposed and being of a resilient material are normally biased into mutual abutment. The conductor 124 is encased in an insulator sleeve 130 the forward end of which terminates in an annular portion 132 comprising a radially spaced apart pair of annular flanges. A base flange of a cylindrical cup member 136 is affixed within portion 132 to protrude forwardly beyond the opposed face 1-92 of the hammer body. The cup-shaped member 136 is of a diameter to be matingly receivable within the external pocket 1-80 of the terminal assembly and has a leading edge comprising a circular cutting edge 138 defined by the external surface of the cup member and an internal chamfer.

Figure 5:
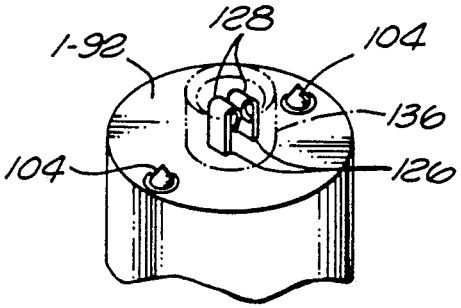
FIG. 5 is a partial perspective view of the opposing face of the hammer of FIGS. 3 and 4 with part of this structure shown in dotted outline to reveal otherwise hidden details of construction.

In the embodiment of FIGS. 3-5, when the hammer body 1-90 is triggered the cup shaped member 136 is thrust into the external pocket 1-80. As a result, the insulator disc 1-96 is displaced from the entrance to the external pocket by the sharp leading edge 138 and the pointed external end 120 of the central terminal 1-70 penetrates the weakened portion 1-98 of the insulator disc. While not illustrated in the drawings, it will be understood that the reversely bent prongs 128 of the central contact arms 126 of the hammer serve as a reactive surface for the outside surface of the insulator disc 1-96 to insure penetration of the disc by the central electrode point 120. As before, the hard contact points 104 of the hammer body embed themselves in and make electrical contact with the external end of the annular electrode 1-44. Simultaneously, the pointed end 120 of the central electrode 1-70 penetrates between the prongs 128 of the hammer body so that the electrical circuit is completed creating a potential in the spark gap G to ignite primer mixture 116 and the propellant 32. In other words, the combination of the central electrode 1-70 and contact prongs 128 work somewhat in the manner of a spade switch to complete the circuit and effect detonation of the charge contained within the bullet.

Figure 6:
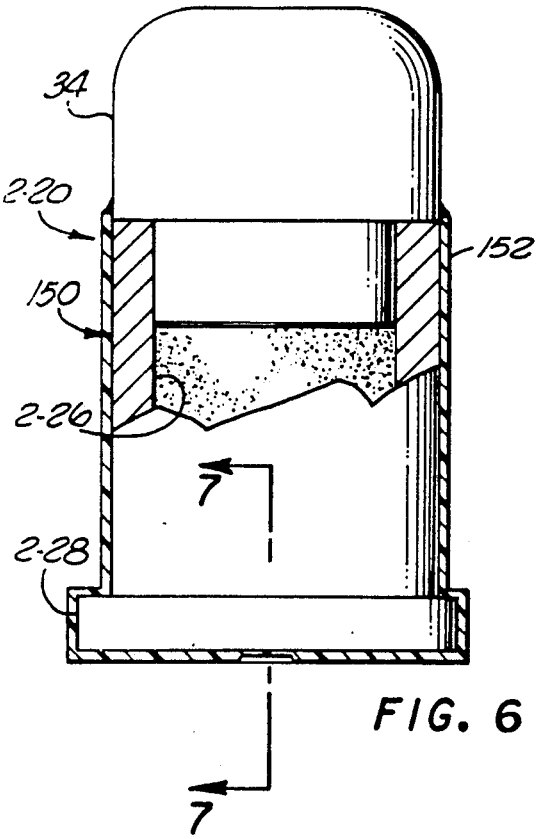
FIG. 6 is a side view of an alternative embodiment of the cartridge with portions cut away to show inner details of construction.
Figure 7:
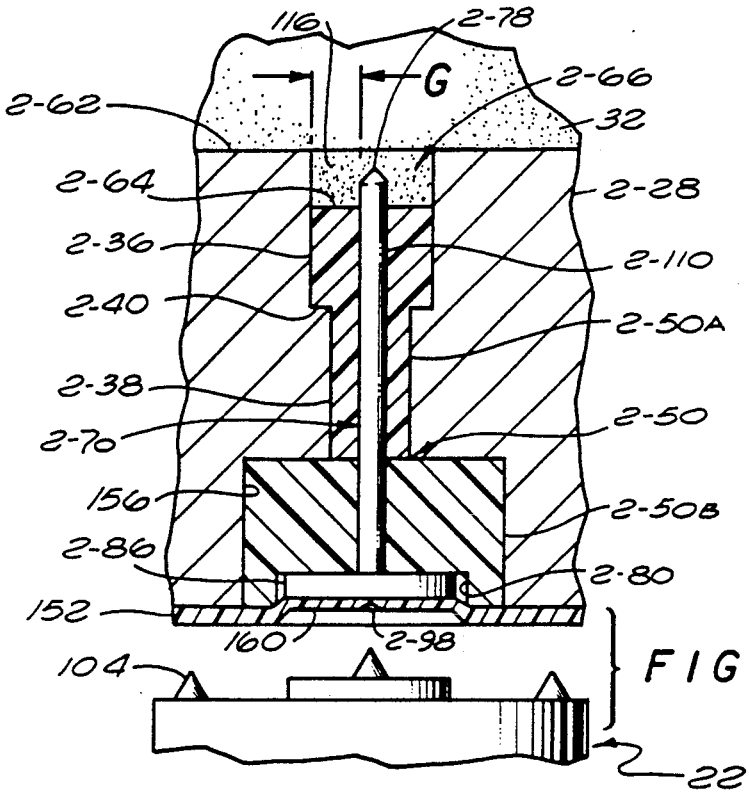
FIG. 7 is a sectional view on the line 7—7 of FIG. 6.

Another embodiment is shown in FIG. 6 and 7. In this case the cartridge system comprises a partially insulated cartridge 2-20 and the previously described hammer 22.

More specifically, the cartridge 2-20 comprises a case, designated generally by the numeral 150, that is made of an electrically conductive material. Case 150 may be made, for example, from a graphite composite, or a conductive synthetic plastic, or a metal. The case 150 has a cylindrical wall portion 2-26 formed integrally with a head section 2-28. An electrical insulator means 152 covers the entire external surface of the case 150 and may take the form, for example, of an acetal resin film, such as Delrin, adhesively secured or hot dip coated around the case. An upper edge (as viewed in FIG. 6) of insulator means 152 extends just onto the head of a bullet or projectile 34 fitted into the open end of the case 150 to ensure against shorting out.

The base or head 2-28 of case 150 is imperforate except for a relatively small diameter coaxially positioned through counterbore comprising a larger diameter section 2-36 and a smaller diameter section 2-38 between which a shoulder 2-40 is defined. This throughbore is also counterbored from the external end to defined a shouldered cylindrical cavity 156.

A central insulator 2-50 is mounted in the head 2-28 comprising an inner plug 2-50A and an outer plug 2-50B. The inner plug is formed with a larger diameter section 2-52 whose underside seats againsts the shoulder 2-40 of the conterbore while the outer plug 2-50B is seated against the floor of the counterbore section or cavity 156. The pair of plugs 2-50A and 2-50B are formed with coaxial holes to matingly receive a rod portion 2-110 of a central electrode 2-70 integrally fitted with an outer end head 2-86 which is seated within an external pocket 2-80 of the plug 2-50B. An inner end face 2-64 of the plug 2-50A is positioned beneath the inner end face 2-62 of the case head 2-28 to define an internal pocket 2-66 into which a pointed end 2-78 of the central electrode 2-70 protrudes. The pocket 2-66 is filled with a primer 116 beneath a charge of the propellant 32.

If employed in the form of a thin film of sheet material, the insulating means 152 includes a circular depressed area 160 hot-pressed onto the external face of the electrode head 2-86, preferably formed with a weakened central point 2-98. The point area 2-98 is positioned in alignment with the central contact point 102 of the hammer 22. As before, the weakened area 2-98 ensures penetration of the insulator means 152 by the central contact point 102 of the hammer with resulting electrical continuity therebetween. The external or outer plug 2-50B is of a lesser diameter than the gap between the pair of contact points 104 of the hammer 22 such that when the pair of contact points 104 penetrate the insulator means 152 they come into electrical contact with the conductive material of the cartridge case 2-24.

In this embodiment the spark gap G appears to be defined between the point 2-78 of the central electrode and the nearest circular trace of the counterbore section 2-36 or the sharp edged circular junction of the inner face 2-62 of the head section of the case with the counterbore.

While the species of FIGS. 6 and 7 does not lend itself to the manufacture of an electrode sub-assembly it nevertheless is conducive to an economical process of manufacturing the cartridge system of this invention. As will now be apparent the case 150 may be made with a solid imperforate head 2-28 which need only be counterbored from the opposite sides to define a relatively small diameter passage required for the reception of the insulator plugs 2-50A and 2-50B. The insulator plugs are adapted for mass production, as is the simple headed-nail configuration of the central electrode 2-70. All of these components can be installed in the empty cartridge case 2-24 prior to application of the insulating means 152.

Figure 8:
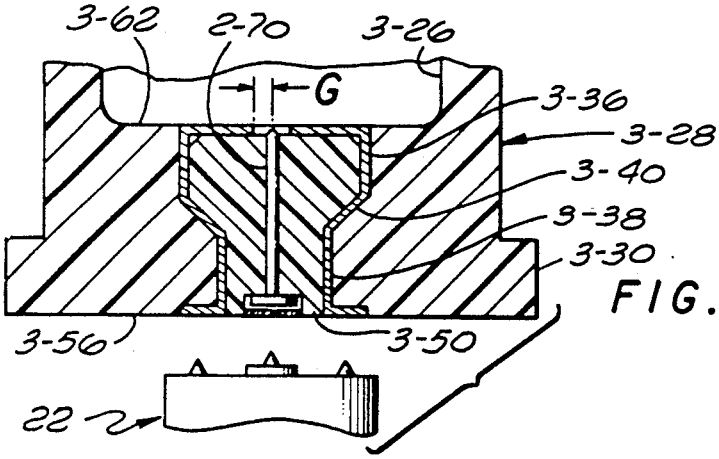
FIG. 8 is a view similar to FIG. 3 but showing yet another embodiment of the invention.
Figure 9:
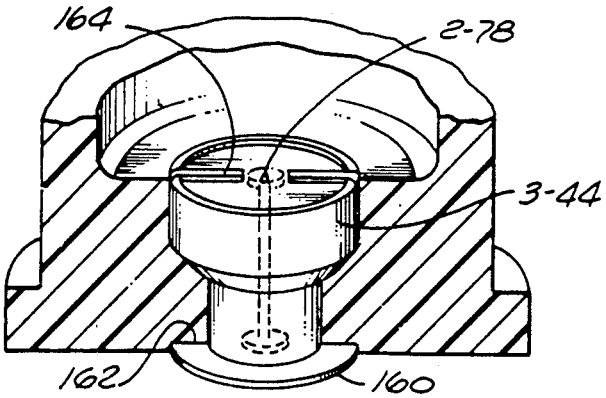
FIG. 9 is a perspective view, partly in section, showing details of construction of the head end of the cartridge of FIG. 8.

That embodiment of the invention shown in FIGS. 8 and 9 also lends itself to the fabrication of an electrode assembly as a preformed sub-assembly. In this embodiment, a cartridge case 3-24 is, again, made of an electrically nonconductive material and comprises cylindrical wall section 3-26 formed integrally with a head section 3-28. The completed cartridge 3-20 may be actuated by essentially the same hammer 22 as described in connection with the first embodiment.

The head 3-28 of the case 3-24 is formed with a coaxial throughbore comprising a larger diameter section 3-36 and a lesser diameter section 38, separated by a frustoconical section 3-40 which tapers convergently in the direction of the external end face 3-56 of the cartridge case. The electrode assembly 3-42 to be mounted in the throughbore comprises an annular electrode 3-44, central insulator 3-50 and a central electrode which may be like the electrode 2-70 of the embodiment shown in FIG. 7.

More particularly, the annular electrode 3-44 may be made out of a length of brass tubing or the like having a body section formed into a configuration which is matingly complementary to the bore sections 3-36, 3-40, and 3-38. An external end portion of annular electrode 3-44 is deformed, as by swaging, into an annular flange or ring 160 that is seated within an annular shoulder 162 defined in the external end face 3-56 of the cartridge case head 3-28. As will be apparent the ring 160 could be formed as a separate piece and then affixed to the body portion of the annular electrode. As shown in FIG. 8, the ring 160 confronts hammer contact points 104. At the inner end of annular electrode 3-44 a pair of aligned, radially inwardly projecting narrow arms or fingers 164 are provided, preferably formed integrally with the material of the body of the electrode. The spaced apart and opposed radially inner ends of the pair of fingers 164 define spark gap G relative to the inner end point 2-78 of central electrode 2-70.

The annular electrode 3-44 is preferably formed with a uniform wall thickness and the central insulator 3-50 has an external configuration or surface matingly complementary to the internal surface configuration of the annular electrode. An inner end surface 3-64 of the central insulator is spaced slightly beneath the internal face 3-62 of the head of the cartridge case to define a shallow internal pocket 3-66 for the fingers 164 and within which a primer charge or a portion of propellant 32 can be received.

The external end face of central insulator 3-50 is formed with a shallow pocket 3-80 within which the head 2-86 of the central electrode 2-70 is seated. The entrance to the pocket 3-80 is normally closed by an insulator disc 96 having weak center area 2-98 in alignment with hammer center contact point 102.

The terminal assembly 3-42 is particularly well adapted to economical production as a sub-assembly. The central insulator 3-50 can be easily molded or machined into the plug-like configuration shown with an external surface configured for mating with the internal surface of the annular electrode 3-44 and with a coaxial hole for the mating reception of the central electrode 2-70. As has been previously remarked, the central electrode itself has the simple configuration of a headed nail. The annular electrode 3-44 may be readily fabricated from a length of cylindrical brass tubing, or an equivalent somewhat malleable electrically conductive material.

More specifically, the length of tubing is first drawn or spun into a shape conforming to the throughbore sections 3-36, 3-38, and 3-40. At the completion of this stage the material which is to be formed into the ring 160 will appear as a cylindrical extension of the cylindrical section 3-38 while the material which will become the fingers 164 may be machined out of a cylindrical extension of the portion 3-36. The plug-like cental insulator 3-50, with or without central electrode 2-70 in place, may be then inserted into place (along with an appropriate adhesive) through the larger diameter of the partially formed electrode piece. The electrode finger material may then be bent over into the final configuration illustrated and adhesively secured in place after which the partially completed sub-assembly is inserted into the throughbore in the head 3-28 of cartridge case 3-24. Thereafter, the material for the ring 1-60 may be swaged or spun into the shoulder pocket 162 on the external end face 3-56. As will be apparent, the mode of operation of the completed cartridge 3-20 is essentially the same as that of the first described cartridge 20.

I claim:

1. In an electrically ignitable cartridge system having a case with a wall defining an internal chamber within said case for a propellant behind a projectile secured to an open end of said case opposite to said projectile, the improvement comprising:

first and second electrical conductor means within said head of said case, each of said conductor means extending between inner and outer faces of said head of said case;

first insulator means for electrically insulating said first and second conductor means from one another;

said first conductor means having an outer end portion terminating within an external pocket formed in an outer face of said first insulator means whereby said outer end portion is recessed relative to said outer face of said head;

a second insulator means in said external pocket that covers said outer end portion of said first conductor means to electrically insulate said outer end of said first conductor means from the ambient surroundings;

said second conductor means having an outer end portion terminating at substantially a plane of said outer face of said head to be axially spaced form said outer end portion of said first conductor means; and hammer means in operative association with said outer end portions of said first and second conductor means for electrically interconnecting said first and second conductor means to an external electrical power source when said hammer means is actuated, said hammer means having a face in opposing relationship to said outer end portions of said first and second conductor means, said hammer face being fitted with first and second electrical contact means in operative alignment with said outer end portions of said first and second conductor means, respectively, said first and second contact means being axially spaced apart a distance substantially corresponding to the axial spacing between said outer end portions of said first and second conductor means;

said second insulator means being made of a material that is penetrable by said first contact means of said hammer means, said outer end portions of said first and second conductor means being made of a material that is penetrable by said first and second contact means of said hammer means, respectively, to electrically energize said first and second conductor means when said hammer means is actuated.

2. A system as in claim 1 wherein:

said first and second contact means of said hammer means each comprises a sharpened contact point.

3. A system as in claim 2 wherein:

said face of said hammer means comprises a boss in which said contact point of said first contact means is mounted, said boss having a cross-sectional configuration that is matingly receivable within said external pocket when said hammer means is actuated.

4. A system as in claim 3 wherein:

said second insulator means comprises a thin film of an insulator material that is formed with a weakened area in alignment with and penetrable by said contact point of said first contact means.

5. A system as in claim 3 wherein:

said second insulator means comprises a thin disc of an insulator material that is normally disposed at an entrance to said external pocket, said outer end portion of said first conductor means comprising a head portion that is spaced inwardly of said external pocket relative to an inner face of said insulator disc, whereby said disc is displaceable from said entrance to said external pocket by said boss when said hammer means is actuated to advance said boss into said external pocket.

6. A system as in claim 2 wherein:

said first insulator means comprises an electrically non-conductive synthetic material of said cartridge case.

7. A system as in claim 6 wherein:

said first conductor means comprises a rod extending coaxially in said head of said case;

said second conductor means comprising an annular electrode around said rod;

said first insulator means further comprising an annular insulator matingly engaged between said rod and said annular electrode, and said external pocket is formed in an external end of said annular insulator.

8. A system as in claim 7 wherein:

said head of said case is centrally formed with a through bore in which said annular electrode is seated, said annular electrode having an external surface that is matingly engaged with said bore, said annular insulator having an external surface that is matingly engaged with an internal surface of said annular electrode, said matingly engaged surfaces of said bore, said annular electrode and said annular insulator having shape characteristics for opposing expulsion thereof from said case.

9. A system as in claim 7 wherein:

said annular insulator is of a shorter axial length than said annular electrode and is positioned such that an inner pocket is defined within an inner end of said annular electrode over an inner end of said annular insulator in communication with the chamber of said case, into which inner pocket an inner end portion of said rod extends and terminates as a portion of said spark gap means.

10. A system as in claim 9 wherein:

said rod of said first conductor means comprises a pop rivet having headed inner and outer ends comprising, respectively, said inner and outer end portions of said first conductor means.

11. A system as in claim 9 wherein:

said rod of said first conductor means is integrally formed with a concentric head positioned against said inner end of said annular electrode and defining said inner end portion of said first conductor means, said rod having a pointed outer end extending into said external pocket of said annular insulator and defining said outer end portion of said first conductor means, said pointed outer end of said rod and said first contact means of said hammer means together defining cooperating portions of a spade switch.

12. A system as in claim 11 wherein:

said first contact means comprises a pair of prongs of a resilient material that are normally biased together into mutual abutment, said prongs extending away from said face of said hammer means to receive said pointed outer end of said rod therebetween upon actuation of said hammer means.

13. A system as in claim 12 wherein:

said second insulator means comprises a thin disc of an insulator material that is normally disposed at the entrance to said external pocket, said face of said hammer means mounts a tubular member around said prongs and extending away from said face, said tubular member having a cross sectional configuration that is matingly receivable within said external pocket, said tubular member having a leading edge that displaces said insulator disc into said external pocket upon actuation of said hammer means.

14. A system as in claim 13 wherein:

said pair of prongs have reversely bent leading portions between which said pointed outer end of said rod is receivable, said reversely bent portions serving as a reactive surface against an outer face of said insulator disc whereby to insure penetration of said disc by said pointed outer end of said rod upon actuation of said hammer means.

15. A system as in claim 8 wherein:

said annular insulator is of a shorter axial length than said annular electrode and is positioned such that an inner pocket is defined within an inner end of said annular electrode over an inner end of said annular insulator in communication with the chamber of said case;

said annular electrode comprises a tubular shell of a metallic material, said inner end portion of first conductor means comprising a pair of aligned radially inwardly projecting fingers integral with the body of said annular electrode having spaced apart and opposed radially inner ends of said fingers defining a part of said spark gap means;

said outer end portion of said second conductor means comprising a radially outwardly projecting flange portion of an outer end of said annular electrode, said outer face of said head of said case having an annular pocket within which said flange is seated with an outer face of said flange essentially flush with said outer face of said head;

said inner end portion of said first conductor means comprising a pointed inner end of said rod terminating in the space between said pair of fingers and comprising a part of said spark gap means.

16. A system as in claim 2 wherein:

said second conductor means comprises an electrically conductive material of said case said first insulator means and said second insulator means together comprising a continuous film of an insulating material that covers the external surface of said case.

17. A system as in claim 16 wherein:

said first conductor means comprises a rod extending coaxially in said head of said case, said outer end portion of said first conductor means comprising an integral head at an outer end of said rod seated within said external pocket;

said head of said case being centrally formed with a through bore containing an annular insulator within which said rod is seated, said annular insulator being of a shorter axial length than said through bore and being positioned such that an inner pocket is defined within an inner end of said through bore over an inner end of said annular insulator in communication with the chamber of said case, into which said inner pocket a pointed inner end portion of said rod extends and terminates as a portion of said spark gap means.

18. A case for an electrically ignitable cartridge, said case comprising:

a cartridge case wall for defining an internal chamber within which a propellant can be received;

a head formed integrally with said wall at an end of said case opposite to a mouth end of said case in which a projectile can be mounted over the propellant;

spaced apart first and second electrical conductor means within said head of said case, each of said conductor means extending between inner and outer faces of said head of said case;

first insulator means for electrically insulating said first and second conductor means from one another;

said first and second conductor means having inner end portions defining a spark gap means therebetween at said inner face of said head;

said head of said case having a coaxial central through bore within which said first conductor means, at least is mounted;

said first conductor means having an outer end portion terminating within an external pocket formed in an outer face of said first insulator means coaxially with said through bore whereby said outer end portion of said first conductor means is recessed relative to said outer face of said head;

a second insulator means in said external pocket that covers said outer end portion of said first conductor means to electrically insulate said outer end of said first conductor means from the ambient surroundings, said second conductor means having an outer end portion terminating at substantially a plane of said outer face of said head to be axially spaced from said outer end portion of said first conductor means.

19. A case as in claim 18 wherein:

said first insulator means comprises an electrically non-conductive synthetic material of said cartridge case.

20. A case as in claim 19 wherein:

said second insulator means comprises a thin film of an insulator material that is formed with a central weakened area.

21. A case as in claim 20 wherein:

said first conductor means comprises a rod extending coaxially in said through bore in said head of said case;

said second conductor means comprising an annular electrode around said rod;

said first insulator means further comprising an annular insulator matingly engaged between said rod and said annular electrode, and said external pocket is formed in an external end of said annular insulator;

said rod, said annular insulator and said annular electrode being formed as a unitary sub-assembly mounted within said through bore in said head of said case.

22. A case as in claim 21 wherein:

said annular electrode has an external surface that is matingly engaged with said through bore;

said annular insulator having an external surface that is matingly engaged with an internal surface of said annular electrode;

said matingly engaged surfaces of said bore, said annular electrode and said annular insulator having shape characteristics for opposing expulsion thereof from said case.

23. A case as in claim 22 wherein:

said annular insulator is of a shorter axial length than said annular electrode and is positioned such that an inner pocket is defined within an inner end of said annular electrode over an inner end of said annular insulator in communication with the chamber of said case, into which inner pocket an inner end portion of said rod extends and terminates as a portion of said spark gap means.

24. A case as in claim 23 wherein:

said rod of said first conductor means comprises a pop rivet having headed inner and outer ends comprising, respectively, said inner and outer end portions of said first conductor means.

25. A case as in claim 20 wherein:

said second insulator means comprises a thin disc of an insulator material that is normally disposed at the entrance to said external pocket;

said first conductor means comprises a rod extending coaxially in said through bore in said head of said case, said rod having a pointed outer end extending into said external pocket and defining said outer end portion of said first conductor means, said pointed outer end of said rod being in alignment with said central weakened area of said second insulator means.

26. A case as in claim 20 wherein:

said first conductor means comprises a rod extending coaxially in said through bore in said head of said case;

said second conductor means comprising an annular electrode around said rod;

said first insulator means further comprising an annular insulator matingly engaged between said rod and said annular electrode, and said external pocket is formed in an external end of said annular insulator;

said annular insulator is of a shorter axial length than said annular electrode and is positioned such that an inner pocket is defined within an inner end of said annular electrode over an inner end of said annular insulator in communication with the chamber of said case;

said annular electrode comprises a tubular shell of a metallic material, said inner end portion of said second conductor means comprising a pair of aligned radially inwardly projecting fingers integral with a body of said annular electrode having spaced apart and opposed radially inner ends of said fingers defining a part of said spark gap means;

said outer end portion of said second conductor means comprising a radially outwardly projecting flange portion of an outer end of said annular electrode;

said outer face of said head of said case having an annular pocket within which said flange is seated with an outer face of said flange essentially flush with said outer face of said head;

said inner end portion of said first conductor means comprising an pointed inner end of said rod terminating in the space between said pair of fingers and comprising a part of said spark gap means.

27. A case as in claim 26 wherein:

said first conductor means comprises a rod extending coaxially in said head of said case, said outer end portion of said first conductor means comprising an integral head at an outer end of said rod seated within said external pocket formed in said outer face of said head of said case;

said head of said case being centrally formed with a through bore containing an annular insulator within which said rod is seated, said annular insulator being of a shorter axial length than said through bore and being positioned such that an inner pocket is defined within an inner end of said through bore over an inner end of said annular insulator in communication with the chamber of said case, into which said inner pocket a pointed inner end portion of said rod extends and terminates as a portion of said spark gap means.

28. A case as in claim 18 wherein:

said second conductor means comprises an electrically conductive material of said case;

said first insulator means and said second insulator means together comprising a continuous film of an insulating material that covers an external surface of said case.

29. A case as in claim 28 wherein:

said first conductor means comprises a rod extending coaxially in said head of said case, said outer end portion of said first conductor means comprising an integral head at an outer end of said rod seated within said external pocket formed in said outer face of said head of said case;

said through bore containing an annular insulator within which said rod is seated, said annular insulator being of a shorter axial length than said through bore and being positioned such that an inner pocket is defined within an inner end of said through bore over an inner end of said annular insulator in communication with the chamber of said case, into which said inner pocket a pointed inner portion of said rod extends and terminates as a portion of said spark gap means.

* * * * *